US008028725B2

(12) United States Patent
Stavrakis et al.

(10) Patent No.: US 8,028,725 B2
(45) Date of Patent: Oct. 4, 2011

(54) FILLING VALVE APPARATUS FOR A BEVERAGE FILLING MACHINE

(75) Inventors: Demetrios Stavrakis, Booklandville, MD (US); Edwin K. Ruble, Parkton, MD (US); Michael J. Brown, Baltimore, MD (US)

(73) Assignee: Adcor Industries, Inc., Baltimore, MD (US)

( * ) Notice: Subject to any disclaimer, the term of this patent is extended or adjusted under 35 U.S.C. 154(b) by 0 days.

(21) Appl. No.: 12/705,419

(22) Filed: Feb. 12, 2010

(65) Prior Publication Data

US 2010/0140523 A1 Jun. 10, 2010

Related U.S. Application Data

(62) Division of application No. 10/985,168, filed on Nov. 10, 2004, now Pat. No. 7,661,449.

(60) Provisional application No. 60/518,777, filed on Nov. 10, 2003, provisional application No. 60/549,129, filed on Mar. 1, 2004.

(51) Int. Cl.
*B65B 31/00* (2006.01)

(52) U.S. Cl. ..... 141/57; 141/47; 141/48

(58) Field of Classification Search ..... 141/46–48, 141/57, 59, 144–147, 301, 302
See application file for complete search history.

(56) References Cited

U.S. PATENT DOCUMENTS 744,271 A 11/1903 Adams
1,061,662 A 5/1913 Crandall
1,154,056 A 9/1915 Reid
1,627,778 A 5/1927 Hutchinson
1,858,595 A 5/1932 Parker et al.
2,707,413 A 5/1955 Goodnow
3,155,126 A * 11/1964 Hi ..... 141/50
3,175,591 A 3/1965 Manas
3,176,731 A 4/1965 Minard
3,289,712 A 12/1966 Smith
3,756,290 A 9/1973 Cleland et al.
4,206,789 A * 6/1980 Jordan et al. ..... 141/39
4,398,575 A * 8/1983 Brandon ..... 141/39
4,700,756 A 10/1987 Minard
4,750,533 A * 6/1988 Yun ..... 141/46
4,893,733 A 1/1990 Thomsen
5,040,574 A 8/1991 Petri et al.
5,085,255 A * 2/1992 LaWarre et al. ..... 141/39
5,150,740 A 9/1992 Yun
5,220,946 A 6/1993 Murao et al.
5,740,844 A 4/1998 Miller
5,975,159 A 11/1999 Persenaire et al.
6,131,624 A * 10/2000 Paradies ..... 141/286
(Continued)

*Primary Examiner* — Timothy L Maust
(74) *Attorney, Agent, or Firm* — Howard & Howard Attorneys PLLC

(57) ABSTRACT

A filling valve apparatus for filling a container with a fluid. The apparatus includes a body portion and a stem. A sleeve is disposed over the stem and is removable from the stem and the body portion when the filling valve apparatus is serviced. A seal is mounted to the bottom of the sleeve. At least one component is movably connected to the sleeve and remains connected to the sleeve when the sleeve is removed from the stem and the body portion during the servicing of the filling valve apparatus. Similarly, a valve assembly, having a housing and a movable plunger is removable from the body portion. At least one member is mechanically connected to one of the housing and plunger for creating a unitary valve assembly that remains intact when the valve assembly is removed from the body portion during servicing of the filling valve apparatus.

20 Claims, 5 Drawing Sheets

U.S. PATENT DOCUMENTS 6,253,811 B1 7/2001 Slagh
7,299,833 B2 * 11/2007 Ruble et al. ..... 141/146
7,661,449 B2 2/2010 Stavrakis et al.

* cited by examiner

FILLING VALVE APPARATUS FOR A BEVERAGE FILLING MACHINE

CROSS-REFERENCE TO RELATED APPLICATIONS

This application is a divisional of U.S. Non-Provisional patent application Ser. No. 10/985,168 filed on Nov. 10, 2004, which is now U.S. Pat. No. 7,661,449, which claims priority to and all the benefits of U.S. Provisional Patent Application Ser. No. 60/518,777, which was filed on Nov. 10, 2003 and U.S. Provisional Patent Application Ser. No. 60/549,129, which was filed on Mar. 1, 2004, the disclosures of which are hereby incorporated by reference.

BACKGROUND OF THE INVENTION

1. Field of the Invention

The subject invention relates to filling valve apparatuses for beverage filling machines and in particular the servicing of the filling valve apparatuses.

2. Description of Related Art

Beverage filling machines typically include, based on size, 40, 60, 72, 100, 120, or 130 filling valve apparatuses. Each of these filling valves progressively fill a container, such as a can or bottle, with a liquid, such as water, soda, or beer. The filling valves are also used when cleaning the beverage filling machine. Typical filling valve apparatuses are shown in U.S. Pat. Nos. 4,750,533; 4,979,546; 5,944,072; and 6,076,567.

The filling valve apparatuses are bolted to the beverage filling machines and include a number of working components. Through repeated cycling of the filling valves, the components have a tendency to wear and must be serviced at regular intervals, such as every 1.5 million cycles. The servicing of each of the filling valves is a time consuming and expensive process. Further, the servicing of the filling valves often causes costly errors. To service the filling valves, each filling valves must be removed from the beverage filling machine by removing a nut from a stud extending from the beverage filling machine. Numerous components, such as seals, springs, valves, etc., must then be separately removed and replaced. Taking into consideration the large number of individual filling valves, such as 72, 100, or 130 filling valves, the servicing process can lead to lengthy down times in the operation of the beverage filling machine and to various mistakes.

Accordingly, it would be desirable to develop a filling valve apparatus that can be easily and efficiently serviced and eliminate the errors associated with the servicing while not sacrificing the performance characteristics of the filling valves.

SUMMARY OF THE INVENTION AND ADVANTAGES

The subject invention includes a filling valve apparatus for filling a container with a fluid. The apparatus comprises a body portion defining a cavity and at least one aperture for directing the fluid into the container. A stem is mounted to the body portion within the cavity and defines a longitudinal passageway extending out of the body portion. A sleeve is disposed over the stem and has a top and a bottom with the bottom extending into the cavity of the body portion. The sleeve is removable from the stem and the body portion when the filling valve apparatus is serviced. A seal is mounted to the bottom of the sleeve for sealing the aperture and preventing fluid from flowing through the aperture. The apparatus is characterized by at least one component movably connected to the sleeve and remaining connected to the sleeve when the sleeve is removed from the stem and the body portion during the servicing of the filling valve apparatus.

The subject invention also includes a filling valve apparatus comprising the body portion defining at least one bore and a passageway extending from the bore. A valve assembly having a housing is disposed within the bore of the body portion. The valve assembly also includes a movable plunger disposed within the housing for selectively allowing fluid to flow through the passageway in the body portion. The apparatus is characterized by at least one member mechanically connected to at least one of the housing and plunger for creating a unitary valve assembly that remains intact when the valve assembly is removed from the bore of the body portion during servicing of the filling valve apparatus.

Accordingly, the subject invention provides a filling valve apparatus that is easily, efficiently, and consistently serviced by unitizing various parts. Further, the servicing of the filling valves is error free. The subject invention dramatically reduces the amount of time required to service the numerous filling valves on a beverage filling machine which in turn reduces the down time for the beverage filling machine.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
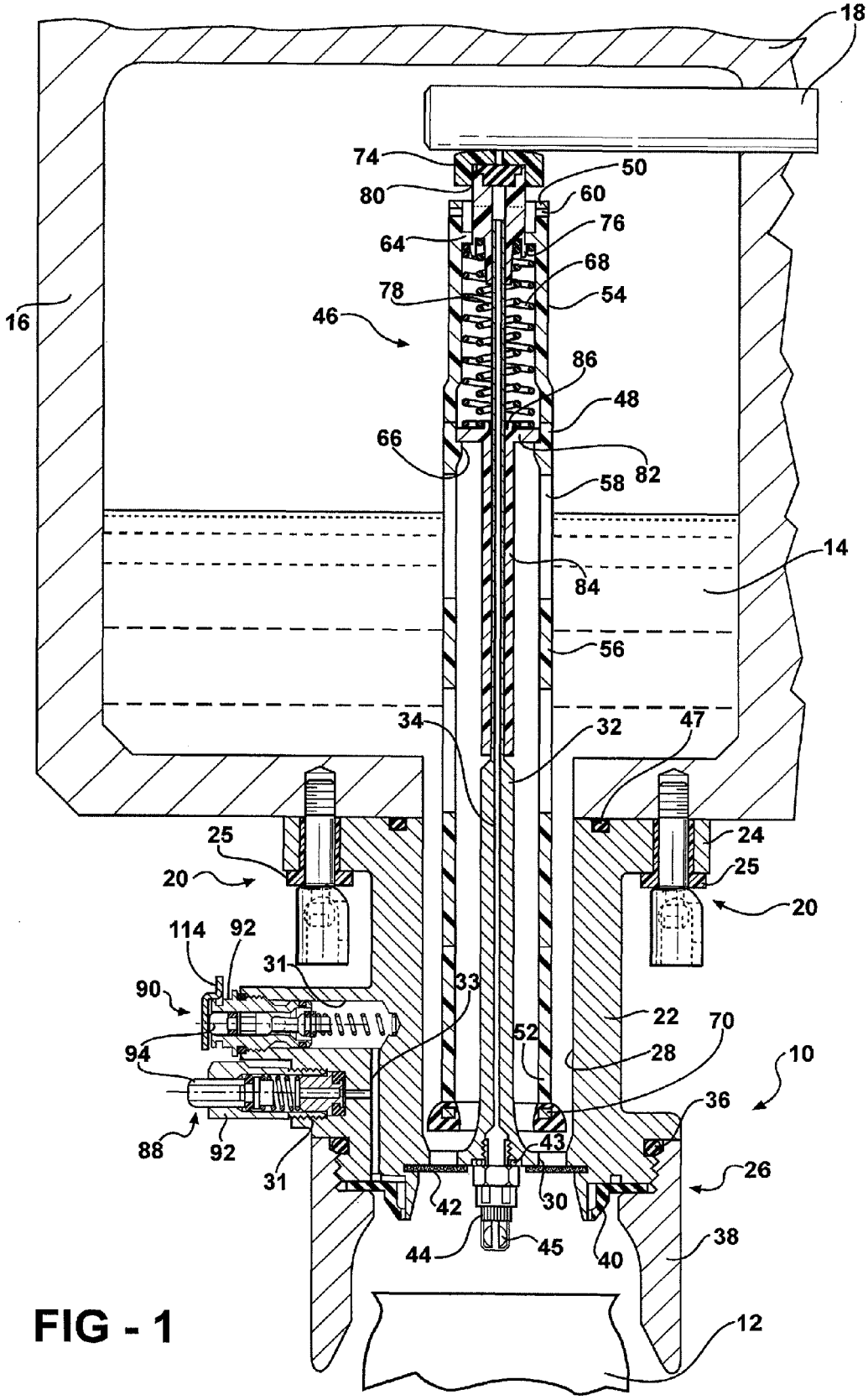
FIG. 1 is a partially cross-sectional view of a filling valve apparatus connected to a beverage filling machine.

Referring to the Figures, wherein like numerals indicate like or corresponding parts throughout the several views, a filling valve apparatus 10 for filling a container 12 with a fluid 14 is shown in FIG. 1. The filling valve apparatus 10 is connected to a tank 16 of a beverage filling machine 18. As discussed in the background section above, there are typically 40, 60, 72, 100, 120, or 130 filling valve apparatuses on any one beverage filling machine. Each of the filling valve apparatuses are substantially identical such that only one filling valve apparatus 10 will be discussed in any greater detail below. The tank 16 and other associated components of the beverage filling machine 18 do not form part of the claimed invention and will therefore not be discussed in any detail. It should be appreciated that the tank 16 and beverage filling machine 18 may be of any suitable design or configuration.

The filling valve apparatus 10 is connected to the tank 16 through a quick connect/release mechanism 20. The quick connect/release mechanism 20 is disclosed and claimed in U.S. patent application Ser. No. 11/079,157, which is herein incorporated by reference. As such, the quick connect/release mechanism 20 will not be discussed in any greater detail.

Figure 2:
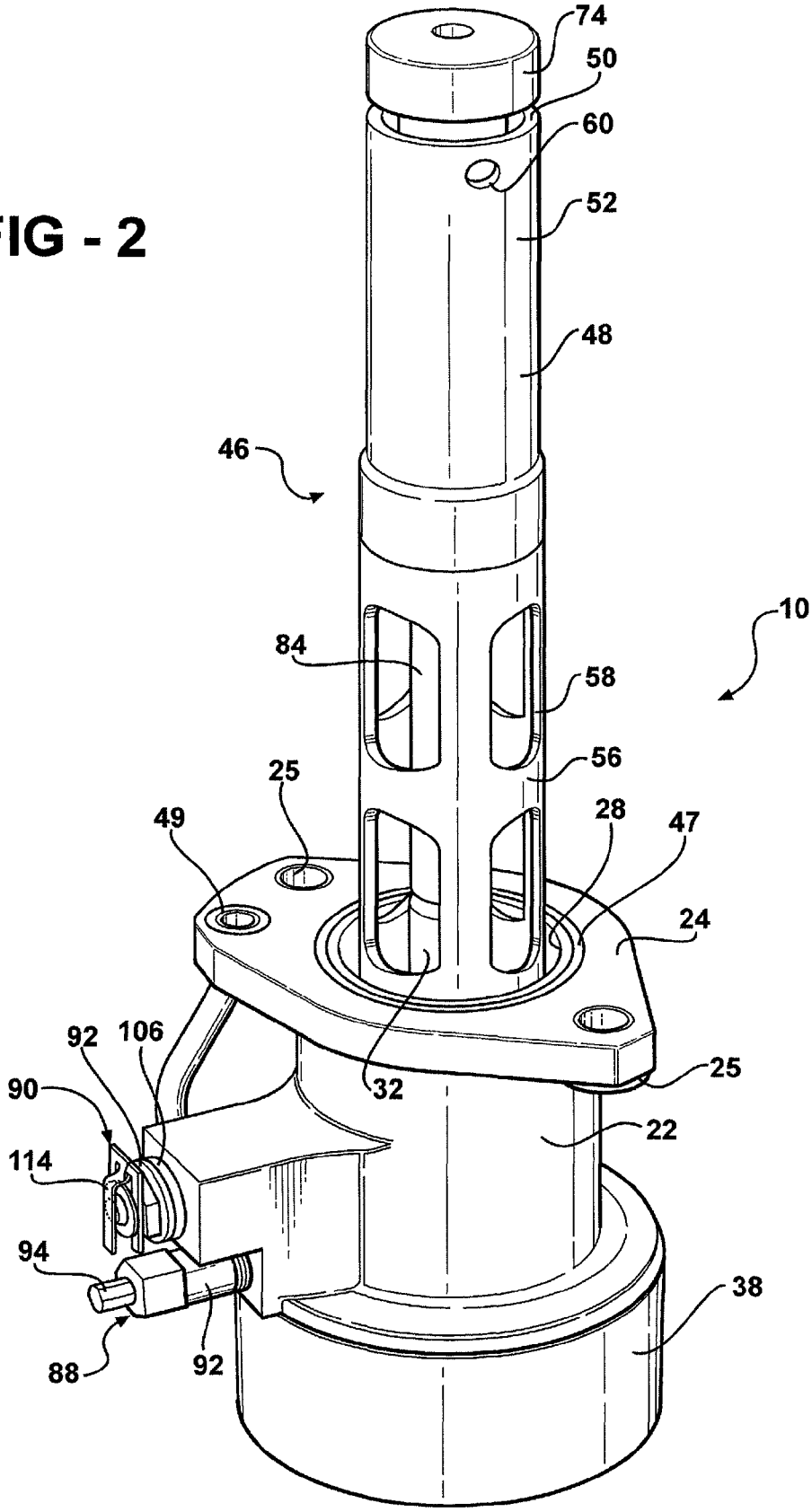
FIG. 2 is a perspective view of the filling valve apparatus.

Referring also to FIG. 2, the filling valve apparatus 10 comprises a body portion 22 having a flange 24 at one end, which abuts the beverage filling machine 18, and a threaded section 26 at an opposing end. The flange 24 includes at least an opening with a bushing 25 disposed within the opening. The quick connect/release mechanism 20 engages the bushing 25 when the filling valve apparatus 10 is installed. The body portion 22 defines a cavity 28 and at least one aperture 30 for directing the fluid 14 into the container 12. The body portion 22 also includes a pair of integral bores 31 and a common passageway 33 extending from the bores 31.

A stem 32 is mounted to the body portion 22 within the cavity 28. The stem 32 defines a longitudinal passageway 34 extending out of the body portion 22. A ring seal 36 is disposed about the threaded section 26 and a valve bell 38 is threadingly connected to the threaded section 26. A container seal 40 is wedged between the body portion 22 and the valve bell 38. A screen 42 and a ball cage 44 are also connected to the body portion 22. A ball 45 is disposed within the ball cage 44 and a small seal 43 is disposed between the ball cage 44 and the body portion 22. Two additional seals 47, 49 are disposed in the flange 24 to seal the cavity 28 and passageway 33, respectively. The configuration and operation of the stem 32, valve bell 38, container seal 40, screen 42, and ball cage 44 are well known to those skilled in the art and will therefore not be discussed in any greater detail.

Figure 3:
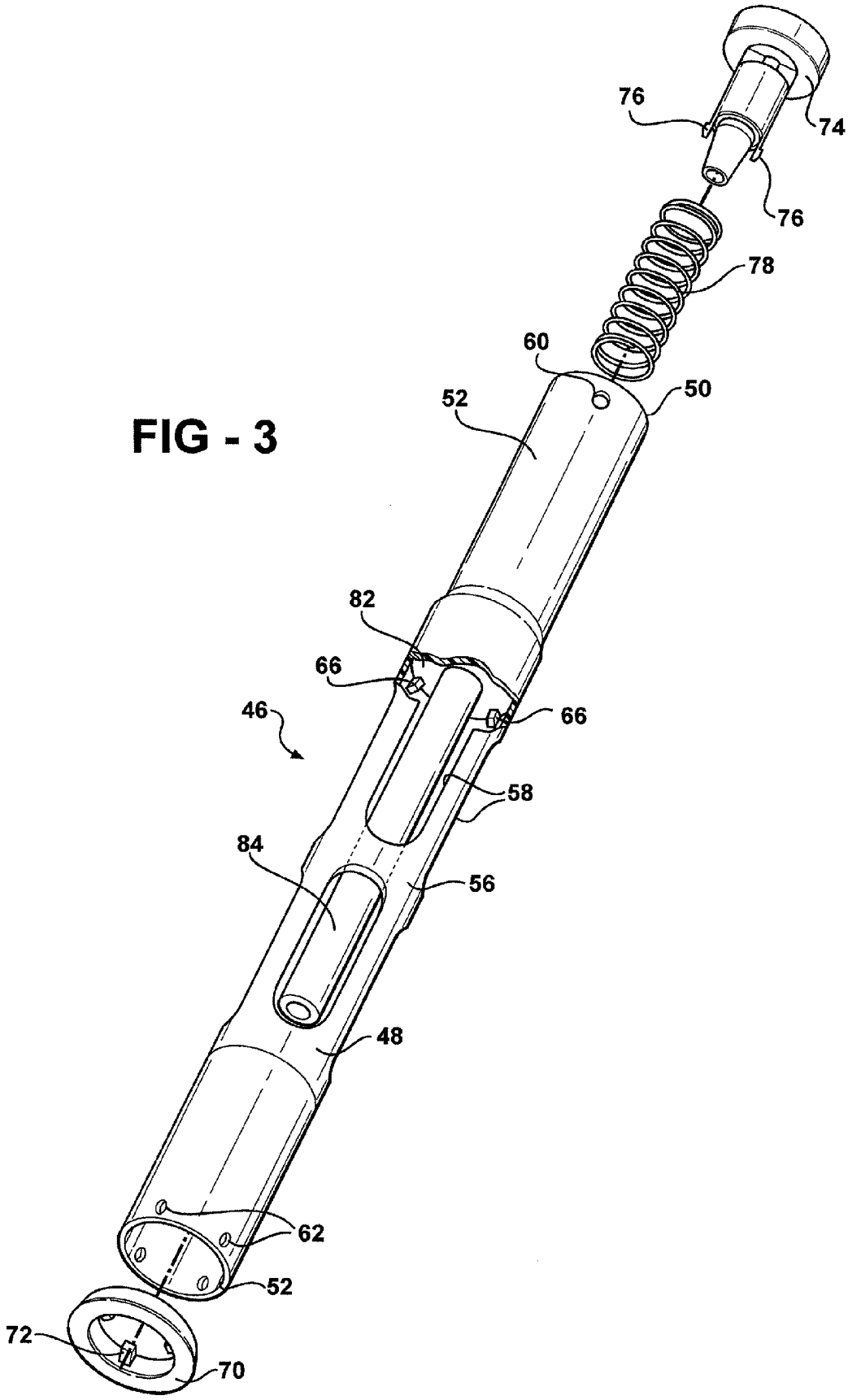
FIG. 3 is an exploded perspective view of a cartridge assembly.
Figure 4:
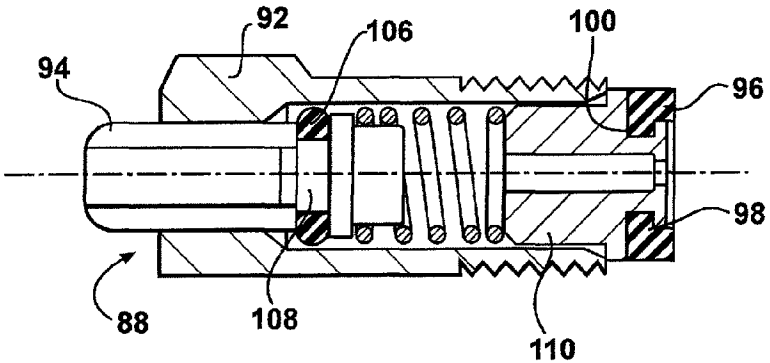
FIG. 4 is a cross-sectional view of a snift valve assembly.
Figure 5:
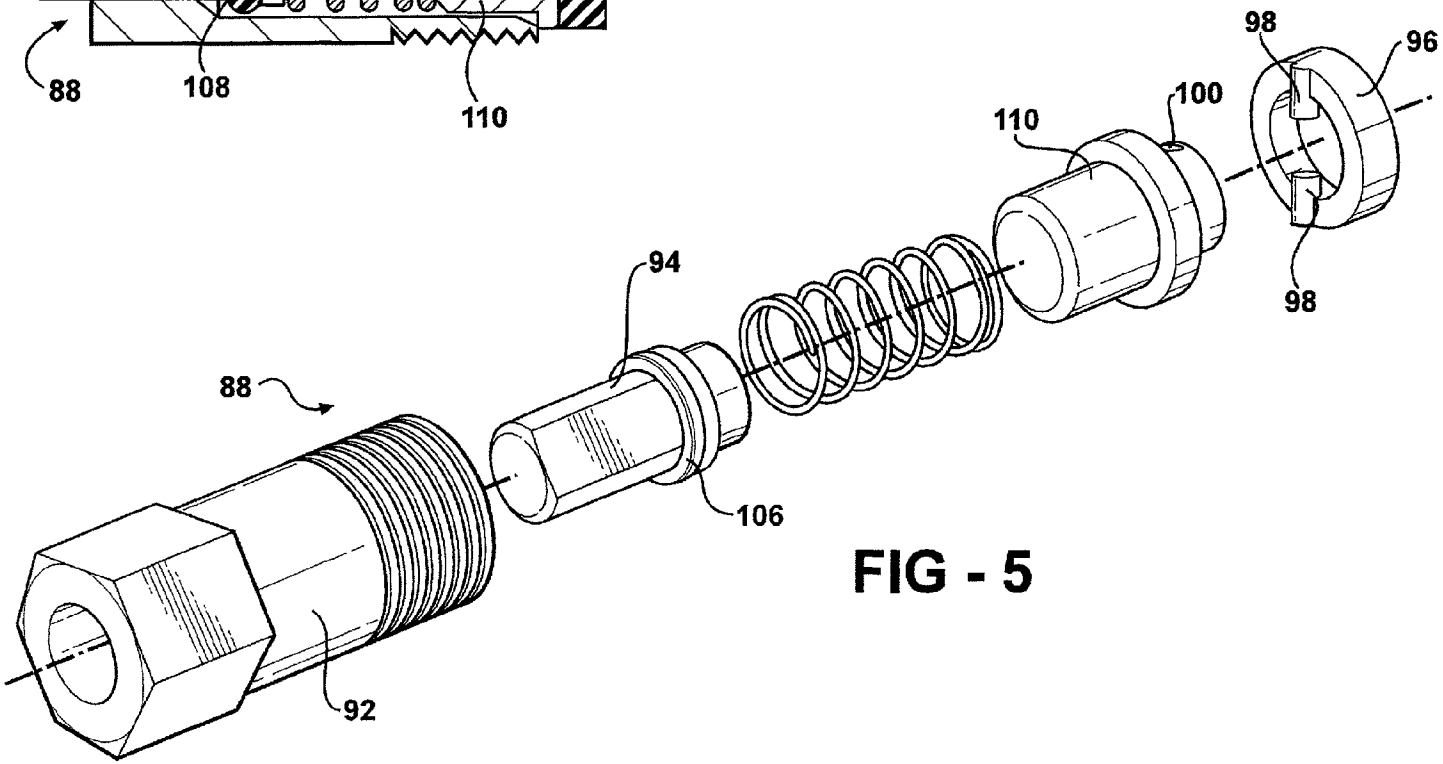
FIG. 5 is an exploded perspective view of the snift valve assembly.
Figure 6:
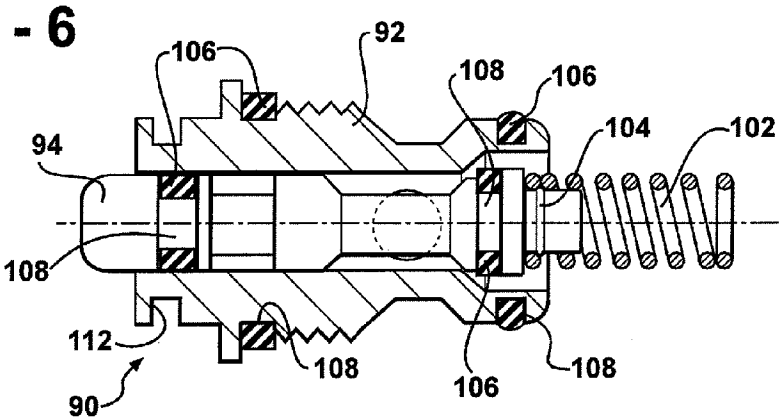
FIG. 6 is a cross-sectional view of a purge valve assembly.
Figure 7:
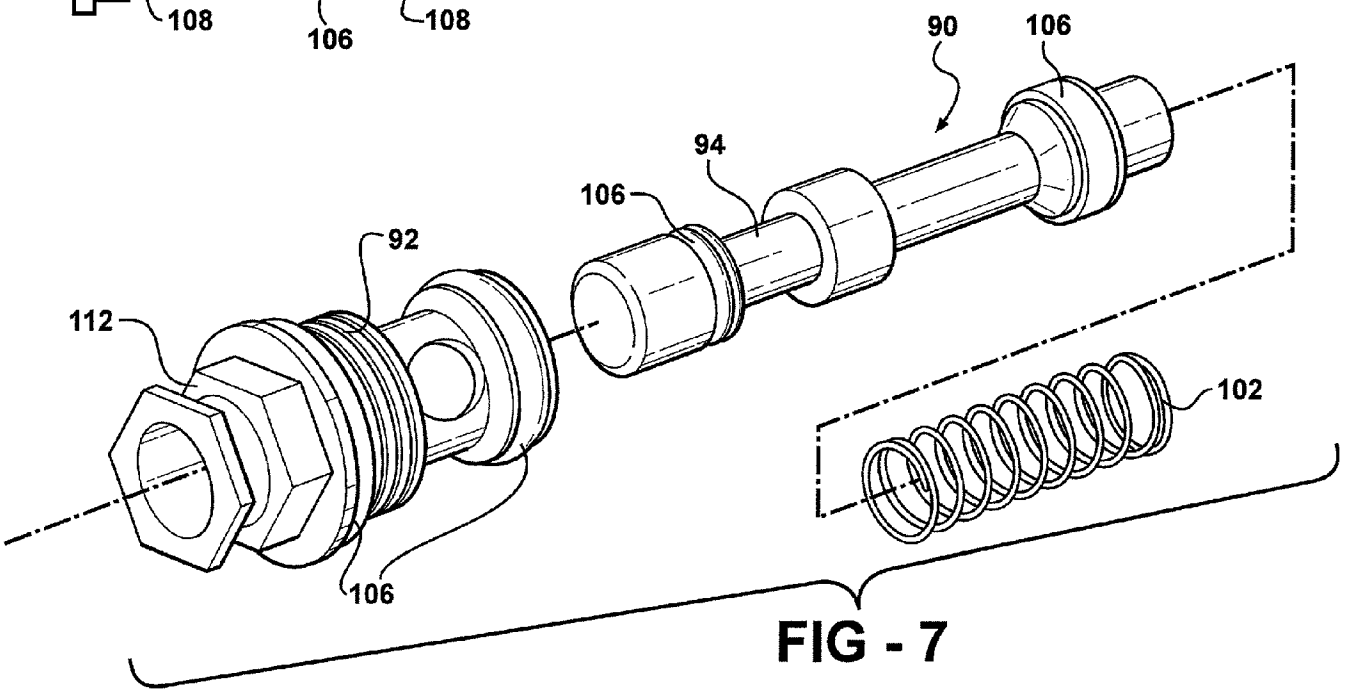
FIG. 7 is an exploded perspective view of the purge valve assembly.

Referring to FIGS. 1-3, the filling valve apparatus 10 includes a cartridge assembly 46. The cartridge assembly 46 in turn includes an elongated sleeve 48 disposed over the stem 32 with the sleeve 48 being removable from the stem 32 and the body portion 22 when the filling valve apparatus 10 is serviced. In fact, as discussed in greater detail below, the entire cartridge assembly 46 is removed from the stem 32 as a single unit when the filling valve apparatus 10 is serviced.

The sleeve 48 has a top 50 and a bottom 52 with the bottom 52 extending into the cavity 28 of the body portion 22. The sleeve 48 also has an upper portion 54 defining a gas chamber and a lower portion 56 having at least one opening 58 defining a liquid chamber. The upper portion 54 of the sleeve 48 defines a port 60 for allowing a gas to escape from the gas chamber and the bottom 52 portion of the sleeve 48 includes at least one hole 62. Preferably, the sleeve 48 can be formed of a plurality of pieces, such as three, connected together to define the upper 54 and lower 56 portions.

The sleeve 48 is preferably of an elongated tubular configuration defining an inner bore. At least one integral flange 64, 66 projects into the bore. Preferably, the sleeve 48 includes first 64 and second 66 flanges. Most preferably, the first 64 and second 66 flanges are part of the upper portion 54 of the sleeve 48 with the first flange 64 disposed at the top 50 of the sleeve 48 and the second flange 66 disposed adjacent the openings 58 in the sleeve 48. Further, the first flange 64 is substantially continuous about the bore of the sleeve 48 and the second flange 66 includes a number of separate flanges 66 extending from the bore of the sleeve 48. Preferably, the sleeve 48 and flanges 64, 66 are formed of a polymeric material.

The sleeve 48 is moveable between a first operable position with the bottom 52 adjacent the aperture 30 for preventing the fluid 14 from flowing into the container 12 and a second operable position with the bottom 52 spaced from the aperture 30 for allowing the fluid 14 to flow into the container 12. A sleeve spring 68 engages the first flange 64 and is coupled to the sleeve 48 for continuously biasing the sleeve 48 into the second operable position with the bottom 52 spaced from the aperture 30.

A seal 70 is mounted to the lower portion 56 of the sleeve 48 for sealing against the body portion 22 and preventing fluid 14 from flowing through and about the liquid chamber. Preferably, the seal 70 is mounted to the bottom 52 of the sleeve 48 for sealing the aperture 30 and preventing fluid 14 from flowing through the aperture 30. The seal 70 includes at least one locator tab 72 engaging the stem 32 and centering the sleeve 48 relative to the stem 32 when the sleeve 48 is disposed over the stem 32 such that the seal 70 aligns with the aperture 30. Preferably, there are three locator tabs 72. In one contemplated embodiment, the hole 62 in the sleeve 48 receives a portion of the seal 70 to secure the seal 70 to the bottom 52 portion of the sleeve 48. In particular, the seal 70 is preferably injection molded about the bottom 52 of the sleeve 48.

The cartridge assembly 46 also includes at least one component movably connected to the sleeve 48 and remaining connected to the sleeve 48 when the cartridge assembly 46 and sleeve 48 are removed from the stem 32 and body portion 22 of the filling valve apparatus 10 during servicing of the filling valve apparatus 10. Hence, the cartridge assembly 46 is removed as a unitary item, which dramatically increases the efficiency of the servicing process and dramatically reduces the errors that occur during servicing. One contemplated mechanism for connecting the components includes the use of the first 64 and second 66 flanges. In particular, the component selectively abuts one of the flanges 64, 66 to retain at least a portion of the component within the sleeve 48.

The component can be defined as any suitable device or part that interacts with the cartridge assembly 46. Specifically, the component is further defined as a cap 74 having at least one locking finger 76 selectively engaging one of the flanges 64, 66 to retain a portion of the cap 74 within the upper portion 54 of the sleeve 48 when the filling valve apparatus 10 is serviced. It should be appreciated that the cap 74 is retained in the filling valve apparatus 10 during the operation of the filling valve apparatus 10 as well. Preferably, the cap 74 includes a pair of locking fingers 76 engaging the first flange 64 at the top 50 of the sleeve 48. A portion of the cap 74 remains outside of the sleeve 48 with the locking fingers 76 remaining within the sleeve 48. A cap spring 78 engages the cap 74 and is coupled to the sleeve 48 for continuously biasing the cap 74 away from the sleeve 48. The cap 74 is preferably formed of a polymeric material. A seal 80 is partially encapsulated by the cap 74 for selectively sealing against the passageway 34 of the stem 32 to prevent gases from flowing through the gas chamber.

The component can also be defined as a spring seat 82 having an outer periphery selectively engaging one of the flanges 64, 66 to retain at least a portion of the spring seat 82 within the sleeve 48 when the filling valve apparatus 10 is serviced. Of course, the spring seat 82 is retained in the sleeve 48 during the operation of the filling valve apparatus 10 as well. Preferably, the outer periphery of the spring seat 82 is substantially annular and engages the second flanges 66 adjacent the openings 58 in the sleeve 48. A tube 84 extends from the spring seat 82 for surrounding a portion of the stem 32 when the sleeve 48 is disposed over the stem 32 for defining a stop position of the spring seat 82. An annular locator 86 extends from the spring seat 82 in a direction opposite the tube 84. Preferably, the spring seat 82, tube 84, and locator 86 are each formed of a common polymeric material.

The cap spring 78 engages the annular locator 86 of the spring seat 82 to locate the cap spring 78. The sleeve spring 68 also engages spring seat 82 at an outside radial position from the cap spring 78. Hence, the cap spring 78 is located within the sleeve 48 spring 68.

The specific operation of the cartridge assembly 46, and the associated parts, during the filling of the container 12 with the fluid 14 is known to those skilled in the art. As such, this operation will not be discussed in any detail.

Referring to FIGS. 1, 2, and 4-7, the filling valve apparatus 10 also includes at least one valve assembly 88, 90. In the embodiment illustrated, there are a pair of valve assemblies 88, 90. The valve assemblies are known in the art as a snift valve assembly 88, shown in FIGS. 4 and 5, and a purge valve assembly 90, shown in FIGS. 6 and 7. The snift valve assembly 88 is used during the normal operation of the filling valve apparatus 10 and the purge valve assembly 90 is used during a cleaning operation of the filling valve apparatus 10. It should be appreciated that the purge valve assembly 90 could be eliminated from the filling valve apparatus 10 without deviating from the overall scope of the subject invention. As with the overall operation of the filling valve apparatus 10 and the operation of the cartridge assembly 46, the operation of the snift 88 and purge 90 valve assemblies is known to those skilled in the art and will therefore not be discussed in any detail.

Each of the snift 88 and purge 90 valve assembles include a housing 92 disposed within an associated bore 31 of the body portion 22. A movable plunger 94 is disposed within the housing 92 for selectively allowing fluid 14 to flow through the passageway 33 in the body portion 22. Preferably, the housing 92 and the plunger 94 are formed of a polymeric material. As with the cartridge assembly 46 discussed above, each of the valve assemblies 88, 90 are removable from the body portion 22 as a unitary item when the filling valve apparatus 10 is serviced, which further increases the efficiency of the servicing process. In other words, various parts remain connected to the valve assemblies 88, 90 when the valve assemblies 88, 90 are removed. In particular, at least one member is mechanically connected to at least one of the housing 92 and plunger 94 for creating a unitary valve assembly 88, 90 that remains intact when the valve assembly 88, 90 is removed from the bore 31 of the body portion 22 during servicing of the filling valve apparatus 10. The member may be any suitable part associated with the valve assemblies 88, 90 such that the valve assemblies 88, 90 remain intact when removed.

In one embodiment, the member is further defined as a seal 96 having at least one tab 98 disposed thereon for coupling to at least one of the housing 92 and the plunger 94. Preferably, the housing 92 includes at least one hole 100 for receiving the tab 98 of the seal 96 to mechanically couple the seal 96 to the housing 92. Most preferably, there are a pair of tabs 98 extending inwardly relative to the seal 96 and a corresponding pair of holes 100 extending inwardly within the housing 92 for receiving the tabs 98.

The member could also be defined as a spring 102 mechanically connected to at least one of the housing 92 and the plunger 94. Preferably, the plunger 94 includes a flange 104 for engaging the spring 102 to mechanically connect the spring 102 to the plunger 94. Further, the member could be a seal 106 integrally molded to at least one of the housing 92 and the plunger 94. The housing 92 can include at least one groove 108 with the seal 106 integrally molded to the groove 108 of the housing 92. Further, the plunger 94 can include at least one groove 108 with the seal 106 integrally molded to the groove 108 of the plunger 94. Alternatively, a sealing compound may be incorporated into the grooves 108 of the housing 92 and/or plunger 94. The plunger 94 is also slidably secured within the housing 92. The plunger 94 may be secured to the housing 92 through the press fit nature of the seal 106 on the plunger 94. Alternatively, a plug 110 may be connected to the housing 92 to retain the plunger 94 within the housing 92. The plug 110 is preferably adhered to the housing 92 such that, once installed, the plug 110 becomes an integral part of the housing 92. The plug 110 includes the holes 100 for receiving the tabs 98 of the seal 96. The various items discussed above, including the seals 96, 106, spring 102, and plug 110, could be utilized in either of the snift 88 or purge 90 valve assemblies.

In the embodiments illustrated, the snift valve assembly 88 includes the seal 96 having the tabs 98 for coupling to the housing 92. Specifically, the tabs 98 engage the holes 100 in the plug 110. The plunger 94 of the snift valve assembly 88 includes the groove 108 with the seal 106 integrally molded to the groove 108 of the plunger 94. The plunger 94 of the snift valve assembly 88 is also slidably secured within the housing 92 by the plug 110 adhered to the housing 92.

The purge valve assembly 90 illustrated includes the spring 102 mechanically connected to the flange 104 of the plunger 94. Further, both the housing 92 and the plunger 94 include the grooves 108 with seals 106 integrally molded to the grooves 108 of the housing 92. The plunger 94 of the purge valve assembly 90 is secured to the housing 92 through the press fit nature of the seal 106 on the plunger 94.

The cartridge assembly 46, valve assemblies 88, 90, and seals 36, 40, 43, 47, 49 form a servicing kit for servicing the filling valve apparatus 10 of the beverage filling machine 18 wherein each of the cartridge assembly 96, valve assemblies 88, 90, and seals 36, 40, 43, 47, 49 are replaced on the filling valve apparatus 10 during a servicing of the filling valve apparatus 10. The plurality of seals 36, 40, 43, 47, 49 include the ring seal 36, container seal 40, ball cage seal 43, and seals 47, 49 in the flange 24. It should be appreciated that fewer or more seals may be replaced during servicing without deviating from the scope of the subject invention. The valve assemblies 88, 90 can include both the snift valve assembly 88 and the purge valve assembly 90. The servicing kit can also include the ball 45 for the ball cage 44 and the bushings 25. The servicing kit provides an all-in-one kit for performing a complete maintenance of the filling valve apparatus 10.

The servicing operation of the filling valve apparatus 10 is greatly improved through the development of the subject invention. The filling valve apparatus 10 is first quickly and easily removed from the beverage filling machine 18 through the use of the quick connect/release mechanism 20. The cartridge assembly 46 is then removed as a single unit. Once removed, the bushings 25 can be inspected and replaced. The cartridge assembly 46 can now be accessed and replaced with a new cartridge assembly 46, as a single unit. A majority of the parts of the cartridge assembly 46 are formed of a relatively inexpensive polymeric material such that the cartridge assembly 46 could be disposed of after being removed. Alternatively, some of the parts could be reused in subsequent cartridge assemblies. The snift 88 and purge 90 valve assemblies are also removed as single units and replaced with new snift 88 and purge 90 valve assemblies in simplified and single steps. Similarly, a majority of the parts of the valve assemblies 88, 90 are formed of the relatively inexpensive polymeric material such that the valve assemblies 88, 90 may also be disposed of after being removed. Of course, some parts may be reused in subsequent valve assemblies 88, 90.

The valve bell 38 can also be removed from the body portion 22 such that the ring seal 36 and container seal 40 can be replaced. The valve bell 38 is then re-installed and tightened. The ball cage can be removed and serviced by inserting a new seal 43 and ball 45. The seals 47, 49 on the flange 24 of the body portion 22 are also replaced using the servicing kit.

The unitary nature of the cartridge 46 and valve 88, 90 assemblies ensure that all of the working components are replaced, which in turn equates to reliable and consistent error free maintenance of the filling valve apparatuses 10. The filling valve apparatus 10 is then re-installed onto the beverage filling machine 18 through the quick connect/release mechanism 20 and the entire servicing of the filling valve 10 is complete.

As best shown in FIGS. 1 and 2, the housing 92 of the purge valve assembly 90 further includes an exterior notch 112. A clip 114 selectively engages the exterior notch 112 to retain the clip 114 onto the housing 92 with the clip 114 also engaging the plunger 94 to retain the plunger 94 in a predetermined operable position. The plunger 94 is retained in this position during the operation of the filling valve apparatus 10 such that the plunger 94 is not unnecessarily actuated during operation.

The invention has been described in an illustrative manner, and it is to be understood that the terminology which has been used is intended to be in the nature of words of description rather than of limitation. As is now apparent to those skilled in the art, many modifications and variations of the present invention are possible in light of the above teachings. It is, therefore, to be understood that within the scope of the appended claims the invention may be practiced otherwise than as specifically described.

What is claimed is:

1. A filling valve apparatus for filling a container with a fluid, said apparatus comprising:

a body portion defining a cavity and at least one aperture for directing the fluid into the container and said body portion defining at least one bore and a passageway extending from said bore;

a valve assembly having a housing disposed within said bore of said body portion and a movable plunger disposed within said housing for selectively allowing fluid to flow through said passageway in said body portion with the valve assembly being removable from the body portion when said filling valve apparatus is serviced; and at least one member mechanically connected to at least one of said housing and plunger for creating a unitary valve assembly that remains intact when said valve assembly is removed from said bore of said body portion during said servicing of said filling valve apparatus;

wherein said member is further defined as a seal having at least one tab disposed thereon for coupling to at least one of said housing and said plunger.

2. An apparatus as set forth in claim 1 wherein said housing includes at least one hole for receiving said tab of said seal to mechanically couple said seal to said housing.

3. An apparatus as set forth in claim 1 further including a second member further defined as a second seal integrally molded to at least one of said housing and said plunger.

4. An apparatus as set forth in claim 3 wherein said plunger includes at least one groove with said second seal integrally molded to said groove of said plunger.

5. An apparatus as set forth in claim 1 wherein said plunger is slidably secured within said housing.

6. An apparatus as set forth in claim 5 further including a plug connected to said housing to retain said plunger within said housing.

7. An apparatus as set forth in claim 1 further including a stem mounted to said body portion within said cavity and defining a longitudinal passageway extending out of said body portion.

8. An apparatus as set forth in claim 7 further including a sleeve disposed about said stem having a seal for sealing said aperture and preventing fluid from flowing through said aperture, said sleeve being removable from said stem and said body portion when said filling valve apparatus is serviced.

9. An apparatus as set forth in claim 1 wherein said housing and said plunger are formed of a polymeric material.

10. A filling valve apparatus for filling a container with a fluid, said apparatus comprising:

a body portion defining a cavity and at least one aperture for directing the fluid into the container and said body portion defining at least one bore and a passageway extending from said bore;

a valve assembly having a housing disposed within said bore of said body portion and a movable plunger having a projection defining a groove and a flange spaced from said projection with said plunger disposed within said housing for selectively allowing fluid to flow through said passageway in said body portion with the valve assembly being removable from the body portion when said filling valve apparatus is serviced; and at least one member mechanically connected to at least one of said housing and plunger for creating a unitary valve assembly that remains intact when said valve assembly is removed from said bore of said body portion during said servicing of said filling valve apparatus;

wherein said member is further defined as a spring abutting said projection and engaging said flange such that said spring remains mechanically connected to said plunger when said valve assembly is removed from said bore of said body portion.

11. An apparatus as set forth in claim 10 further including a second member further defined as a seal integrally molded to said groove of said projection.

12. An apparatus as set forth in claim 10 further including a third member further defined as a second seal with said housing including at least one second groove with said second seal integrally molded to said second groove of said housing.

13. An apparatus as set forth in claim 10 wherein said housing includes an exterior notch.

14. An apparatus as set forth in claim 13 further including a clip selectively engaging said exterior notch to retain said clip onto said housing with said clip also engaging said plunger to retain said plunger in a predetermined operable position.

15. An apparatus as set forth in claim 10 wherein said plunger is slidably secured within said housing.

16. A filling valve apparatus for filling a container with a fluid, said apparatus comprising:

a body portion defining a cavity and at least one aperture for directing the fluid into the container and said body portion defining at least one bore and a passageway extending from said bore;

a valve assembly having a housing disposed within said bore of said body portion and a movable plunger disposed within said housing for selectively allowing fluid to flow through said passageway in said body portion with the valve assembly being removable from the body portion when said filling valve apparatus is serviced; and at least one member mechanically connected to at least one of said housing and plunger for creating a unitary valve assembly that remains intact when said valve assembly is removed from said bore of said body portion during said servicing of said filling valve apparatus;

a clip selectively engaging said housing for retaining said clip onto said housing with said clip also engaging said plunger to retain said plunger in a predetermined operable position.

17. An apparatus as set forth in claim 16 wherein said housing includes an exterior notch for receiving said clip.

18. An apparatus as set forth in claim 16 wherein said member is further defined as a seal and said housing includes at least one groove with said seal integrally molded to said groove of said housing.

19. An apparatus as set forth in claim 18 wherein said plunger includes at least one groove with said seal integrally molded to said groove of said plunger.

20. An apparatus as set forth in claim 16 wherein said plunger is slidably secured within said housing.

* * * * *